US005399933A

United States Patent [19]

Tsai

[11] Patent Number: 5,399,933

[45] Date of Patent: Mar. 21, 1995

[54] MAGNETIC BEAM ADJUSTING RINGS WITH DIFFERENT THICKNESS

[75] Inventor: Sen-Su Tsai, Taoyuan, Taiwan, Prov. of China

[73] Assignee: Chunghwa Picture Tubes, Ltd., Taoyuan, Taiwan, Prov. of China

[21] Appl. No.: 63,736

[22] Filed: May 20, 1993

[51] Int. Cl.[6] ..... H01J 29/70

[52] U.S. Cl. ..... 313/431; 313/412; 313/413; 313/421; 313/425; 335/212; 335/302; 335/306; 335/210; 273/126 A

[58] Field of Search ..... 313/431, 413, 412, 421, 313/425; 335/212, 302, 306, 210; 273/126 A

[56] References Cited

U.S. PATENT DOCUMENTS

| | | | |
|---|---|---|---|
| 2,569,327 | 8/1948 | Obert | 313/75 |
| 2,586,948 | 3/1951 | Heppner | 313/76 |
| 2,597,298 | 3/1952 | Court | 335/212 |
| 3,701,065 | 10/1972 | Mirsch | 335/212 |
| 3,725,831 | 4/1973 | Barbin | 335/212 |
| 3,742,406 | 6/1973 | Erickson | 335/212 |
| 3,764,144 | 10/1973 | Arthur | 273/126 A |
| 3,808,570 | 4/1974 | Thompson et al. | 335/212 |
| 4,570,140 | 2/1986 | Teruaki | 335/212 |
| 5,227,692 | 7/1993 | Lee | 313/431 |

*Primary Examiner*—Sandra L. O'Shea
*Assistant Examiner*—Ali Horri
*Attorney, Agent, or Firm*—Emrich & Dithmar

[57] ABSTRACT

A pair of ring-shaped magnets, or magnetic pole pieces, having the same magnetic field strength, or magnetic flux density, are disposed about the neck portion of a cathode ray tube (CRT) for statically converging a plurality of inline electron beams on the CRT's faceplate. The magnetic ring pair includes an inlet ring magnet facing the CRT's base and an outlet ring magnet facing the CRT's faceplate, with the inlet ring magnet having a thickness greater than that of the outlet ring magnet along the CRT's longitudinal axis. The inlet ring magnet thus exerts a larger off-axis force on the electron beam than the outlet ring magnet because of the longer beam path in the inlet ring magnet to permit the magnetic ring pair to apply a maximum convergence correction for substantially misconverged electron beams and a minimum convergence correction when the beams are in convergence. The pair of ring magnets may also be used in a color purity magnet assembly to adjust electron beam convergence to provide a high degree of color purity.

15 Claims, 1 Drawing Sheet

MAGNETIC BEAM ADJUSTING RINGS WITH DIFFERENT THICKNESS

FIELD OF THE INVENTION

This invention relates generally to color cathode ray tubes (CRTs) having a plurality of inline electron beams and is particularly directed to a magnet assembly for controlling the relative positions of the electron beams in the CRT and providing for the convergence of the beams on the CRT's faceplate.

BACKGROUND OF THE INVENTION

Magnetic structures are typically employed in a color CRT for converging the electron beams at the center of the CRT's faceplate. This adjustment is known as statically converging the electron beams, which typically are in an inline array. Each of the magnetic structures is generally comprised of a set of magnetic ring-shaped pole piece pairs, or ring magnets, disposed in a spaced manner along and about the cylindrical neck portion of the CRT. In order to control the convergence of three inline electron beams in a color CRT, three sets of ring-shaped pole piece pairs of magnets are provided, with two-pole, four-pole and six-pole magnets employed in each respective pair of magnetic rings. Static convergence of the electron beams is typically adjusted by means of the four-pole magnet assembly and the six-pole magnet assembly. The four-pole magnet assembly includes two superposed four-pole ring-shaped permanent magnets, while the six-pole magnet assembly includes two six-pole ring-shaped permanent magnets disposed about the CRT's neck portion. An example of this electron beam magnetic convergence arrangement is disclosed in U.S. Pat. No. 3,808,570 to Thompson et al.

The electron beams from the respective electron guns are converged at the center of the fluorescent screen on the CRT's faceplate with the beams undeflected by adjusting the intensity of the magnetic fields produced by the respective magnets of the assembly. Each magnet assembly is typically comprised of two ring-shaped permanent magnets having the same polarity and the same magnetic flux density, or magnetic field strength, which may be rotated to vary the intensity of the magnetic field of the magnet assembly. The intensity of the field of the magnet assembly is minimum when the polarities of the two permanent ring magnets are aligned. The intensity of the field of the magnet assembly may be varied by rotating the permanent magnets relative to each other.

The two ring-shaped permanent magnets are also typically the same size, having the same inner and outer diameters and thickness along the CRT's longitudinal axis. There is an inherent problem with this type of ring-shaped permanent magnet arrangement in that each magnet exerts the same deflection force on the electron beam, causing the electron beam to deviate from its original path giving rise to undesired aberration in the electron gun region or a shift in the beam deflection center resulting in a degradation of video image color purity.

One approach for reducing these undesirable effects is disclosed in U.S. Pat. No. 4,570,140 to Teruaki. In this approach, pairs of ring-shaped permanent magnets having unequal magnetic strength are employed to provide a maximum convergence correction for grossly misaligned beams and a minimum correction when the beams are in substantial convergence. An inlet ring-shaped magnet is provided with a magnetic field strength 10–30% larger than that of the exit ring-shaped magnet. By applying unequal magnetic field strengths to the electron beam along the axis of the CRT, electron beam path deviation is reduced. However, while the two ring-shaped magnets have different magnetic strength, they are virtually identical in other physical characteristics such as size and shape. These two magnets are thus easily interchanged during CRT assembly causing the magnetic field strength on the exit side of the magnet assembly to be greater than that on the entrance side making it very difficult, if not impossible, to realize static convergence of the electron beams on the production line. In addition, providing the two magnets with the desired relative magnetic field strengths increases CRT cost and makes it more difficult to achieve uniformity and quality control in production.

The present invention addresses and resolves the aforementioned problems of the prior art by providing a matched pair of ring-shaped magnetic pole pieces each having the same magnetic field intensity which applies a non-uniform magnetic field to the electron beam for effecting convergence of the electron beams.

OBJECTS AND SUMMARY OF THE INVENTION

Accordingly, it is an object of the present invention to provide an improved magnet assembly for converging a plurality of spaced electron beams on the faceplate of a color CRT.

It is another object of the present invention to provide a magnet assembly for use in a multi-electron beam CRT capable of applying a maximum convergence correction for grossly misaligned beams as well as a minimum convergence correction when the beams are in substantial convergence.

Yet another object of the present invention is to provide a matched magnet pair for use in adjusting the color purity and static convergence in a color CRT which affords more reliable, error-free assembly of the pair of magnets and more precise control of the magnetic flux density of the matched pair of magnets.

A further object of the present invention is to provide minimum convergence correction for the electron beams in a color CRT using first and second aligned ring magnets each having the same magnetic field strength, or flux density.

A still further object of the present invention is to provide an electron beam magnetic convergence arrangement including a pair of ring magnets of different thickness to facilitate the correct assembly of the two magnets.

These objects of the present invention are achieved and the disadvantages of the prior art are eliminated by a magnet assembly for adjusting the path of an electron beam in a color cathode ray tube (CRT) having an electron gun for directing a plurality of inline electron beams onto an inner surface of a faceplate of the CRT, the CRT further including a cylindrical neck portion and a funnel portion disposed intermediate and coupled to the neck portion and the faceplate, the magnet assembly comprising: a first rotatable ring magnet disposed about the neck portion of the CRT and having a first magnetic field strength $B_1$ on the longitudinal axis of the CRT and a thickness $t_1$ along the longitudinal axis of the CRT for bending the electron beam a first angle $\alpha_1$ relative to the longitudinal axis; and a second rotatable ring magnet disposed about the neck of the CRT and intermediate the first ring magnet and the funnel portion of the CRT, the second ring magnet having a second magnetic field strength $B_2$ on the longitudinal axis of the CRT and a thickness $t_2$ along the longitudinal axis of the CRT for bending the electron beam a second angle $\alpha_2$ 2 relative to the longitudinal axis, wherein the angles $\alpha_1$ and $\alpha_2$ are in opposed directions, and wherein $B_1=B_2$, $t_1>t_{22}$ and $\alpha_1>\alpha_2$.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE PREFERRED EMBODIMENT

Figure 1:
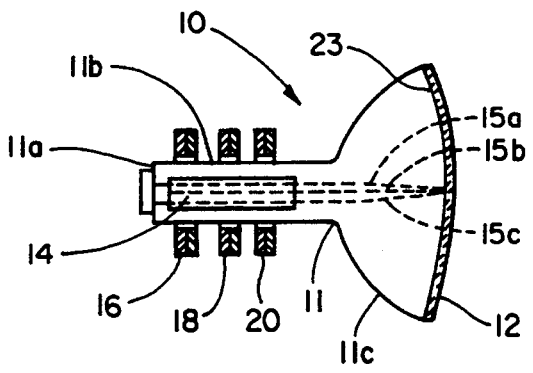
FIG. 1 is a diagrammatic longitudinal top sectional view showing the basic construction of a color CRT including an inline electron gun and employing a plurality of magnet assemblies in accordance with the principles of the present invention.

Referring to FIG. 1, there is shown a diagrammatic longitudinal top sectional view of a CRT 10 incorporating an inline electron gun 14 and provided with magnet assemblies in accordance with the present invention. CRT 10 includes a glass envelope 11 including a base portion 11*a*, a funnel portion 11*c*, and a neck portion 11*b* disposed therebetween. Positioned on the open, enlarged end of the funnel portion 11*c* of glass envelope 11 in a sealed manner is a glass faceplate 12. Electron gun 14 generates and directs a plurality of inline electron beams 15*a*, 15*b* and 15*c* onto a fluorescent layer 23 on the inner surface of glass faceplate 12 in generating a video image thereon. Disposed about the CRT's neck portion 11*b* in a spaced manner are a two-pole purity magnet assembly (dipole) 16, a four-pole magnet assembly (quadrupole) 18 and a six-pole magnet assembly 20. The latter two magnet assemblies are used to adjust the static convergence of the three electron beams 15*a*, 15*b* and 15*c* on the CRT's faceplate 12.

Figure 2:
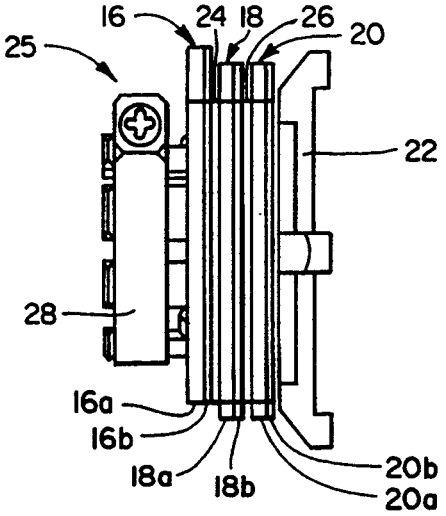
FIG. 2 is a side view showing an electron beam adjusting device including three magnet assemblies in accordance with the present invention for adjusting electron beam convergence.

Referring to FIG. 2, there is shown a side view of an electron beam adjusting device 25 including the aforementioned dipole magnet assembly 16, the four-pole magnet assembly 18 and the six-pole magnet assembly 20 in accordance with the present invention. The three magnet assemblies 16, 18 and 20 are mounted on a magnet holder 22 comprised of a non-magnetic material such as plastic and are each provided with an opening (not shown in the figure) for receiving the CRT's neck portion. A first non-magnetic spacer 24 is disposed intermediate the dipole magnet assembly 16 and the four-pole magnet assembly 18, while a second non-magnetic spacer 26 is disposed intermediate the four-pole magnet assembly 18 and the six-pole magnet assembly 20. Magnetic holder 22 is securely attached to the CRT's neck portion by means of a stainless steel clamping fixture 28. As viewed in FIG. 2, energetic electrons in the electron beams disposed within the CRT's neck portion travel from left to right.

The dipole magnet assembly 16 includes first and second ring-shaped magnetic pole pieces 16*a* and 16*b*. Similarly, the four-pole and six-pole magnet assemblies 18, 20 respectively include first and second ring-shaped pole pieces 18*a*, 18*b* and 20*a*, 20*b*. With the electron beams traveling from left to right in the figure, the first pole piece in each of the aforementioned pairs of pole pieces may be referred to as the inlet pole piece, or inlet magnet, while the second pole piece in each pair may be referred to as the outlet pole piece, or outlet magnet. Each of the dipole magnet, four-pole magnet, and six-pole magnet assemblies 16, 18 and 20 is of similar construction and operation in effecting convergence of the electron beams. Therefore, the present invention will be described in terms of the dipole magnet assembly 16, it being understood that this discussion is equally applicable to four-pole and six-pole magnet assemblies for effecting static convergence in accordance with the present invention.

Figure 3:
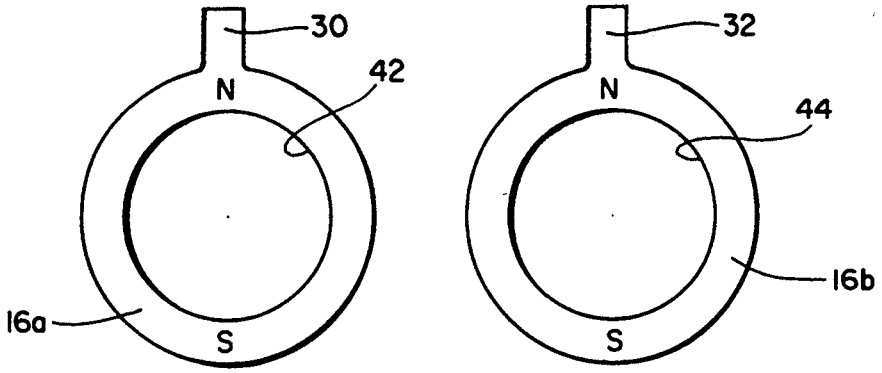
FIG. 3 is a plan view showing the pair of ring-shaped magnets employed in the purity magnet assembly of FIG. 2.
Figure 4:
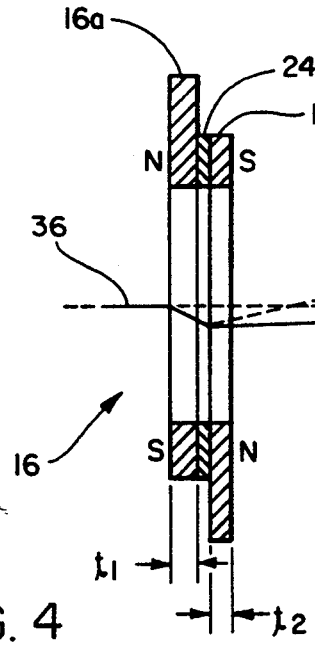
FIG. 4 is a schematic diagram illustrating the manner in which a magnetic assembly including ring-shaped pole piece pairs in accordance with the present invention adjusts the path of an electron beam to achieve multiple electron beam convergence.

The dipole magnet assembly 16 is constructed as follows. As shown in the plan view of FIG. 3 as well as in the cross sectional view of FIG. 4, the dipole magnet assembly 16 is comprised of first and second magnetic ring-shaped pole pieces 16*a* and 16*b* comprised of a magnetic material such as barium ferrite. Each of the first and second magnetic ring-shaped pole pieces 16*a*, 16*b* is provided with a respective tab 30, 32 and is magnetized to have N and S poles, as shown in the figures. As shown in the figures, the portions of the magnetic ring-shaped pole pieces 16*a*, 16*b* near the tabs 30 and 32 are poled N. Each of the first and second magnetic ring-shaped pole pieces 16*a*, 16*b* is of equal magnetic strength. The resultant magnetic field applied to an electron beam 36 directed through the dipole magnet assembly 16 is adjusted in the following manner. When the magnetic ring-shaped pole pieces 16*a* and 16*b* are rotated with respect to each other by gripping their respective tabs 30 and 32 so as to cause the poles of the same polarity to be disposed adjacent each other as shown in FIG. 3, an electron beam passing through the openings of the magnetic ring-shaped pole pieces is shifted to the maximum extent downward as viewed in the figures. When either one of the first or second magnetic ring-shaped pole pieces 16*a*, 16*b* is rotated 180° from this position causing the poles of opposite polarity to be aligned adjacent one another, as shown in FIG. 4, the intensity of the magnetic field of the dipole magnet assembly 16 acting upon the electron beam is minimized resulting in minimal downward bending of electron beam 36.

The dipole magnet assembly 16 operates in the following manner in adjusting for electron beam convergence. As shown in the figures, the first, or inlet, magnetic ring-shaped pole piece 16a has a greater thickness than that of the second, or outlet, magnetic ring-shaped pole piece 16b. Other dimensions of the first and second magnetic ring-shaped pole pieces 16a, 16b, such as their inner and outer diameters, are identical as are their respective magnetic field intensities, or magnetic flux densities. With reference specifically to FIG. 4, it is assumed that the magnetic flux near the center of the first magnetic ring-shaped pole piece 16a flows from the upper toward the lower portion of the pole piece and that the flux near the center of the second magnetic ring-shaped pole piece 16b flows from the lower toward the upper portion of the pole piece. Electron beam 36 traveling from left to right is first deflected downward by the magnetic field produced by the first magnetic ring-shaped pole piece 16a into the field of the second magnetic ring-shaped pole piece 16b. The deflection of the electron beam 40 caused by the field of the second ring-shaped pole piece 16b is smaller than that caused by the field of the first ring-shaped pole piece 16a because the distance the electron beam 36 travels through these pole pieces is less for the second pole piece. In a preferred embodiment, the first pole piece 16a is approximately 10–50% thicker than the second pole piece 16b. In this manner, electron beam 36 experiences a greater off-axis bending force in the inlet portion of the dipole magnet assembly 16 and a weaker bending force in the exit portion of the dipole magnet assembly. Because of the longer electron beam path within a magnetic region of the same strength in the first pole piece 16a, the total "beam bending action" is greater within the region defined by the first pole piece 16a as compared to the region defined by the second pole piece 16b as given by the following expression:

$$\int_0^{T_1} \vec{F}_1\, dt > \int_{T_1}^{T_2} \vec{F}_2\, dt \qquad \text{[Eq. 1]}$$

where $T_1 > (T_2 - T_1)$ and $\vec{F}_1$ = force applied to electron beam by first pole piece;

$\vec{F}_2$ = force applied to electron beam by second pole piece;

$T_1$ = the time required for an electron in the beam to travel through region one defined by the first pole piece;

$T_2$ = the time required for an electron beam to travel through regions one and two defined by the first and second pole pieces.

The force $\vec{F}_1$ exerted on an electron in the beam in the first region defined by the first pole piece 16a can be expressed as follows:

$$\vec{F}_1 = \vec{V}_1 \times \vec{B}_1 \qquad \text{[Eq. 2]}$$

where $\vec{V}_1$ = the velocity of the electron in the first region defined by the first pole piece; and $\vec{B}_1$ = magnetic field intensity of the first pole piece.

Similarly, the force $\vec{F}_2$ applied to an electron in the beam in the second region defined by the second pole piece 16b is given by the following expression:

$$\vec{F}_2 = \vec{V}_2 \times \vec{B}_2, \qquad \text{[Eq. 3]}$$

where $\vec{V}_2$ = velocity of the electron in the second region defined by the second pole piece; and $\vec{B}_2$ = magnetic field intensity of the second pole piece.

Figure 4A:
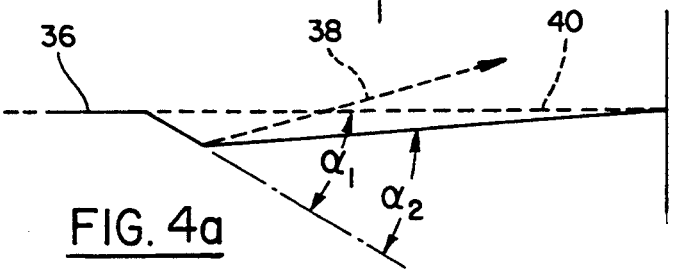
FIG. 4*a* is a schematic diagram of a portion of FIG. 4 illustrating the bending of an electron beam by a magnet assembly of the present invention to achieve electron beam convergence.

Because the first and second pole pieces 16a, 16b have the same magnetic field intensity, or $\vec{B}_1 = \vec{B}_2$, an electron in the beam can only change direction without undergoing a change in energy. Therefore, $\vec{V}_1 = \vec{V}_2$, and the net effect is that the electron beam undergoes less bending from its original path within the second pole piece 16b than within the first pole piece 16a. This is shown in FIG. 4a which shows the path of electron beam 36 through the dipole magnet assembly. As shown in FIG. 4a, electron beam 36 is initially deflected downward over an angle $\alpha_1$ from its initial path by the first ring-shaped pole piece 16a. Electron beam 36 then undergoes an upward bending over and angle $\alpha_2$ within the second ring-shaped pole piece 16b, where $\alpha_2 < \alpha_1$. The net effect is that electron beam 36 undergoes less deviation from its original beam path when bent by the magnetic field of the second pole piece 16b. If the second pole piece 16b were as thick along the electron beam path 40 as the first pole piece 16a with each pole piece having the same magnetic field intensity, the electron beam 40 would undergo greater deflection as shown by dotted arrow 38. Thus, when the dipole magnet assembly 16 is combined with an ideal color CRT wherein the electron beams from the electron gun travel along dotted-line path 40 and are directed onto the center of the CRT's faceplate there is essentially zero shift- ing of electron beams on the CRT's faceplate for improved color dipole adjustment.

There has thus been shown a magnet assembly including a pair of ring-shaped magnets, or magnetic pole pieces, having the same magnetic field strength which are disposed about the neck portion of a color CRT for converging a plurality of in-line electron beams on the CRT's faceplate. The magnetic ring pair includes an inlet ring magnet into which the electron beam is directed and an outlet ring magnet through which the electron beam exits toward the CRT's faceplate. The inlet and outlet ring magnets are multi-polar and rotatable about the CRT's neck portion for adjusting the magnetic field strength along the CRT's longitudinal axis. The inlet ring magnet has a thickness greater than that of the outlet ring magnet along the CRT's longitudinal axis for exerting a larger off-axis bending force on the electron beam and that exerted by the outlet ring magnet. The reduced bending of the beam by the outlet ring magnet causes the electron beams to converge along the original axis of the incident electron beam. In a preferred embodiment, the inlet ring magnet is 10–50% thicker than the outlet ring magnet. This approach takes advantage of the greater accuracy available in sizing the magnetic rings than that available in imparting a given magnetic field strength to a ring. In addition, the difference in thickness in the magnetic rings facilitates their correct assembly on the CRT's neck portion, with the assembling procedure rendered even more reliable and accurate by color coding of the two ring magnets.

While particular embodiments of the present invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

I claim:

1. For use in a color cathode ray tube (CRT) having an electron gun for directing a plurality of inline electron beams onto an inner surface of a faceplate of said CRT, said CRT further including a cylindrical neck portion and a funnel portion disposed intermediate and coupled to said neck portion and said faceplate, a magnet assembly for adjusting the path of an electron beam comprising:

a first rotatable ring magnet disposed about the neck portion of said CRT and having a first magnetic field strength $B_1$ on the longitudinal axis of said CRT and a thickness $t_1$ along the longitudinal axis of said CRT for bending the electron beam a first angle $\alpha_1$ relative to said longitudinal axis; and a second rotatable ring magnet disposed about the neck of said CRT intermediate said first ring magnet and the funnel portion of said CRT, said second ring magnet having a second magnetic field strength $B_2$ on the longitudinal axis of said CRT and a thickness $t_2$ along the longitudinal axis of said CRT for bending said electron beam a second angle $\alpha_2$ relative to said longitudinal axis, wherein said angles $\alpha_1$ and $\alpha_2$ are in opposed directions, and wherein $B_1=B_2$, $0.1\ t_1 \leqq t_2 \leqq 0.5\ t_1$, and $\alpha_1 > \alpha_2$.

2. The magnet assembly of claim 1 comprising a color purity adjustment arrangement.

3. The magnet assembly of claim 3 wherein each of said first and second ring magnets is a two-pole annular magnet.

4. The magnet assembly of claim 1 comprising a static convergence adjustment arrangement.

5. The magnet assembly of claim 4 wherein each of said first and second ring magnets is either a four-pole annular magnet or a six-pole annular magnet.

6. The magnet assembly of claim 1 wherein each of said first and second ring magnets includes a respective tab adapted for manual engagement for facilitating rotation of the ring magnet about the longitudinal axis of said CRT.

7. The magnet assembly of claim 1 wherein said first and second ring magnets are color coded to facilitate distinguishing said first ring magnet from said second ring magnet during manufacture of said magnet assembly.

8. The magnet assembly of claim 7 wherein said first ring magnet is a first color and said second ring magnet is a second color.

9. The magnet assembly of claim 1 further comprising a non-magnetic spacer disposed intermediate said first and second ring magnets.

10. A magnet arrangement for use in a color cathode ray tube (CRT) including an inline electron gun in a neck portion of said CRT for directing three inline electron beams onto a face-plate of said CRT, said magnet arrangement comprising:

a purity magnet assembly disposed on the neck portion of said CRT and including a first pair of axially opposed inlet and outlet magnetic rings each having two poles, wherein said electron beams pass in a direction from said inlet ring to said outlet ring;

first and second static convergence magnet assemblies disposed on the neck portion of said CRT in spaced relation from said dipole magnet assembly, wherein said first static convergence magnet assembly includes a second pair of axially opposed inlet and outlet magnetic rings each having four poles and said second static convergence magnet assembly includes a third pair of axially opposed inlet and outlet magnetic rings each having six poles;

wherein said sets of magnetic rings are rotatable about the neck portion of said CRT for adjusting the magnetic flux density applied to the three electron beams passing through said rings within the neck portion of said CRT, and wherein bending of said electron beams may be either increased or decreased by rotating either an inlet magnetic ring or an outlet magnetic ring in at least one of said purity magnet assembly or said first or second static convergence magnet assemblies; and wherein at least one of said purity magnet assembly or said first or second static convergence magnet assemblies includes an inlet magnetic ring having a thickness $t_1$ and an outlet magnetic ring having a thickness $t_2$ along a longitudinal axis of said CRT with said inlet and outlet magnetic rings having equal magnetic flux density along the longitudinal axis of said CRT, where $0.1\ t_1 \leqq t_2 \leqq 0.5\ t_1$, wherein electron beam path undergoes a larger shift in said inlet magnetic ring than in said outlet magnetic ring and wherein said shift is adjustable from a maximum to a minimum value from a given electron beam axis corresponding to ideal color dipole and static convergence which is essentially zero.

11. The magnet arrangement of claim 10 further comprising a plurality of non-magnetic spacers each disposed intermediate the inlet and outlet magnetic rings in each of said purity and said first and second static convergence magnet assemblies.

12. The magnet arrangement of claim 11 further comprising non-magnetic spacers disposed intermediate said purity magnet assembly and said first static convergence magnet assembly and intermediate said first and second static convergence magnet assemblies.

13. The magnet arrangement of claim 10 wherein each magnetic ring includes a respective tab adapted for manual engagement for facilitating rotation of the magnetic ring about the longitudinal axis of said CRT.

14. The magnet arrangement of claim 10 wherein said inlet and outlet magnetic rings are color coded to facilitate distinguishing said inlet magnetic ring from said outlet magnetic ring during manufacture of said magnet arrangement.

15. The magnet arrangement of claim 14 wherein said inlet magnetic ring is a first color and said outlet magnetic ring is a second color.

* * * * *

UNITED STATES PATENT AND TRADEMARK OFFICE

CERTIFICATE OF CORRECTION

PATENT NO. : 5,399,933

DATED : March 21, 1995

INVENTOR(S) : Sen-Su Tsai

It is certified that error appears in the above-indentified patent and that said Letters Patent is hereby corrected as shown below:

Title page, item [75], change "Prov. of China" to --Republic of China--.

Title page, item [73], change "Prov. of China" to --Republic of China--.

Col.6, line 30, after the word "zero" change the word "shift- ing" to read --shifting--.

Signed and Sealed this

Fifth Day of September, 1995

Bruce Lehman

*Attest:*

BRUCE LEHMAN

*Attesting Officer*

*Commissioner of Patents and Trademarks*